US010905613B2

(12) United States Patent
Lehman

(10) Patent No.: US 10,905,613 B2
(45) Date of Patent: Feb. 2, 2021

(54) TRANSFER BOARD

(71) Applicant: Kurt Lehman, New Castle, DE (US)

(72) Inventor: Kurt Lehman, New Castle, DE (US)

( * ) Notice: Subject to any disclaimer, the term of this patent is extended or adjusted under 35 U.S.C. 154(b) by 292 days.

(21) Appl. No.: 15/862,892

(22) Filed: Jan. 5, 2018

(65) Prior Publication Data

US 2019/0209407 A1 Jul. 11, 2019

(51) Int. Cl.
*A61G 7/10* (2006.01)
*A61G 5/14* (2006.01)

(52) U.S. Cl.
CPC ..... *A61G 7/103* (2013.01); *A61G 5/14* (2013.01); *A61G 7/1001* (2013.01); *A61G 2200/34* (2013.01)

(58) Field of Classification Search
CPC .... A61G 7/103; A61G 7/1007; A61G 7/1034; A61G 7/1036; A61G 7/1025
See application file for complete search history.

(56) References Cited

U.S. PATENT DOCUMENTS 3,329,978 A * 7/1967 Porter ..... A61G 7/1046 5/81.1 R
3,962,736 A * 6/1976 Fedele ..... A61G 1/003 5/81.1 HS
4,644,594 A * 2/1987 Johnson ..... A61G 1/003 5/428
4,939,799 A * 7/1990 Van Hovel ..... A47K 3/004 4/559
5,036,557 A 8/1991 Fales
5,067,188 A 11/1991 Brantman
5,226,868 A 7/1993 Montgomery
5,282,284 A 2/1994 Brantman et al.
5,735,002 A * 4/1998 Kistner ..... A61G 7/103 5/81.1 HS
5,947,501 A * 9/1999 Osborn ..... A61G 5/10 108/49
6,240,577 B1 * 6/2001 Worthy ..... A47K 3/122 297/217.1
6,681,415 B1 * 1/2004 Gallo ..... A47K 3/122 297/423.3
7,216,383 B2 * 5/2007 Heinl ..... A61B 5/0555 5/601
7,690,055 B2 * 4/2010 Hammer ..... A61G 7/1003 4/560.1

(Continued)

FOREIGN PATENT DOCUMENTS

GB 2236946 4/1991
GB 2270636 3/1994

*Primary Examiner* — Peter M. Cuomo
*Assistant Examiner* — Ifeolu A Adeboyejo
(74) *Attorney, Agent, or Firm* — Norman E. Lehrer

(57) ABSTRACT

A transfer board for assisting in moving a wheelchair bound person from a wheelchair to a bed or similar support includes a flat elongated lightweight board with a smooth upper surface. The board is comprised of two sections; one being narrower than the other so that it can fit onto the seat of a wheelchair. A pair of rigid handles extend upwardly from the sides of the wider section of the board so that a person sitting on the board can grasp the handles and push downwardly on them in order to move his or her body across the board. The ends of the board are inclined downwardly to assist a person in sliding onto and off of the board while the underside of the board includes a nonslip surface.

4 Claims, 2 Drawing Sheets

(56) References Cited

U.S. PATENT DOCUMENTS

| | | | | |
|---|---|---|---|---|
| 8,517,414 | B2 * | 8/2013 | Goldstein | A61G 5/1002<br>280/304.1 |
| 9,114,050 | B2 * | 8/2015 | White | A61G 7/1026 |

* cited by examiner

TRANSFER BOARD

BACKGROUND OF THE INVENTION

The present invention is directed toward a transfer board primarily intended to be used in moving a wheelchair bound person with no legs from a wheelchair to a bed or similar support or back from a bed to the wheelchair. More particularly, the invention is directed toward such a transfer board that includes handles to allow the patient to use his or her arms to assist in moving to or from the wheelchair.

Those with lower extremity disabilities often have difficulty moving from one location to another. Often times these people are confined to a wheelchair and require assistance to transfer between a bed and a wheelchair or similar device.

Presently, assistance in transferring patients can be provided by transfer boards, which are generally solid, smooth, substantially rectangular-shaped plywood boards, approximately 8 or 10 inches wide and 24 to 30 inches long. To move a patient from a bed to a wheelchair, for example, one end of the rectangular transfer board is placed under the patient sitting on the edge of the bed, and the other end of the board is placed on the wheelchair seat. A healthcare provider or other assistant then slides the patient across the board from the bed toward the wheelchair. The patient then sits on the corner of the wheelchair seat, and makes a half turn, backwards into the wheelchair, as the transfer board is removed. Obviously, the process is simply reversed when the patient moves from the wheelchair to the bed.

This operation usually requires considerable strength and effort by the healthcare provider. In many cases, and particularly when the patient lacks any upper body strength or ability, as in the case of a fully disabled person or some senior citizens, more than one person may be needed to help slide the patient across the transfer board. This becomes an even more serious problem when the only assistance available is from someone who also is disabled, or more commonly, a senior citizen.

Furthermore, many transfer boards currently available in the market are too wide for some wheelchairs. If the wheelchair is perfectly lined up to the bed, the board may fit on the chair seat. But if the front of the chair is arranged at an angle to the bed, the board may be too wide and the arms of the chair may interfere with the ability of the board to rest properly on the seat. One solution is to make the board narrower. But if the board is made narrower in order to fit the wheelchair, it could become unstable.

There are situations when the patient is fully capable of assisting a care (liver in moving himself or herself between a wheelchair and a bed or the like. It is not uncommon for a person who has lost his or her legs to still have the use of their arms. In some cases, they may even have developed significant upper body strength. Transfer boards currently on the market, however, do not easily allow a patient to help in the transfer as there is no convenient place for the patient to place his or her hands. While they may be able to hold the transfer board itself, this may require that they bend over and reach down, making it very awkward and difficult to be of much assistance.

SUMMARY OF THE INVENTION

The present invention is designed to overcome the deficiencies of the prior art discussed above. It is an object of the present invention to provide a transfer board that allows a patient with upper body strength to assist in transferring himself or herself from a wheelchair to a bed or chair and back again.

It is a further object of the present invention to provide a transfer board that allows a patient with upper body strength to assist in transferring himself or herself from a wheelchair to a bed or chair and back again and which is more stable than pre-existing transfer boards.

In accordance with the illustrative embodiment demonstrating features and advantages of the present invention, there is provided a transfer board for assisting in moving a wheelchair bound person from a wheelchair to a bed or similar support that includes a flat elongated lightweight board with a smooth upper surface. The board is comprised of two sections; one being narrower than the other so that it can fit onto the seat of a wheelchair. A pair of rigid handles extend upwardly from the sides of the wider section of the board so that a person sitting on the board can grasp the handles and push downwardly on them in order to move his or her body across the board. The ends of the board are inclined downwardly to assist a person in sliding onto and off of the board while the underside of the board includes a nonslip surface.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
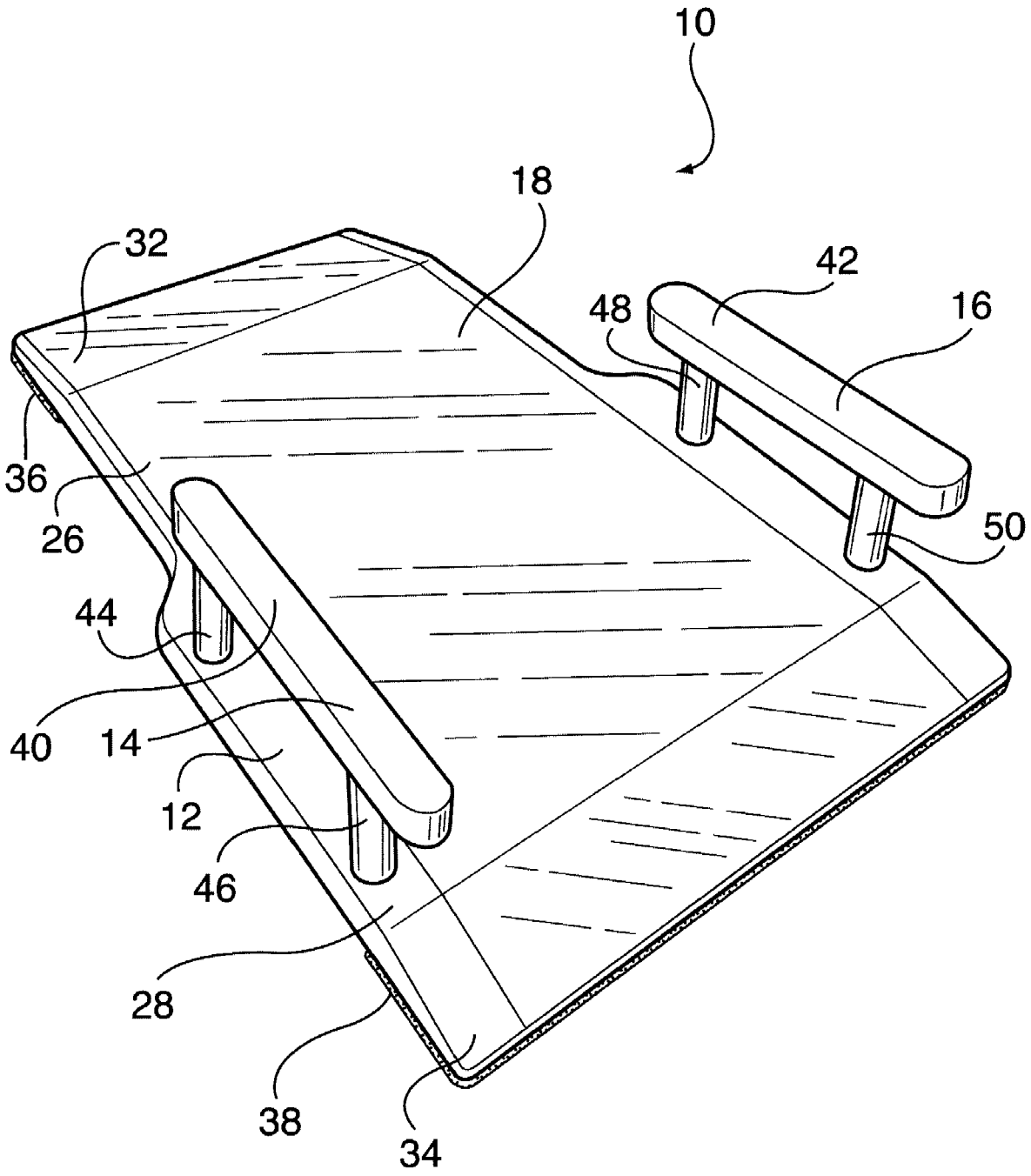
FIG. 1 is a front, top and left side perspective view of a transfer board in accordance with my invention.
Figure 2:
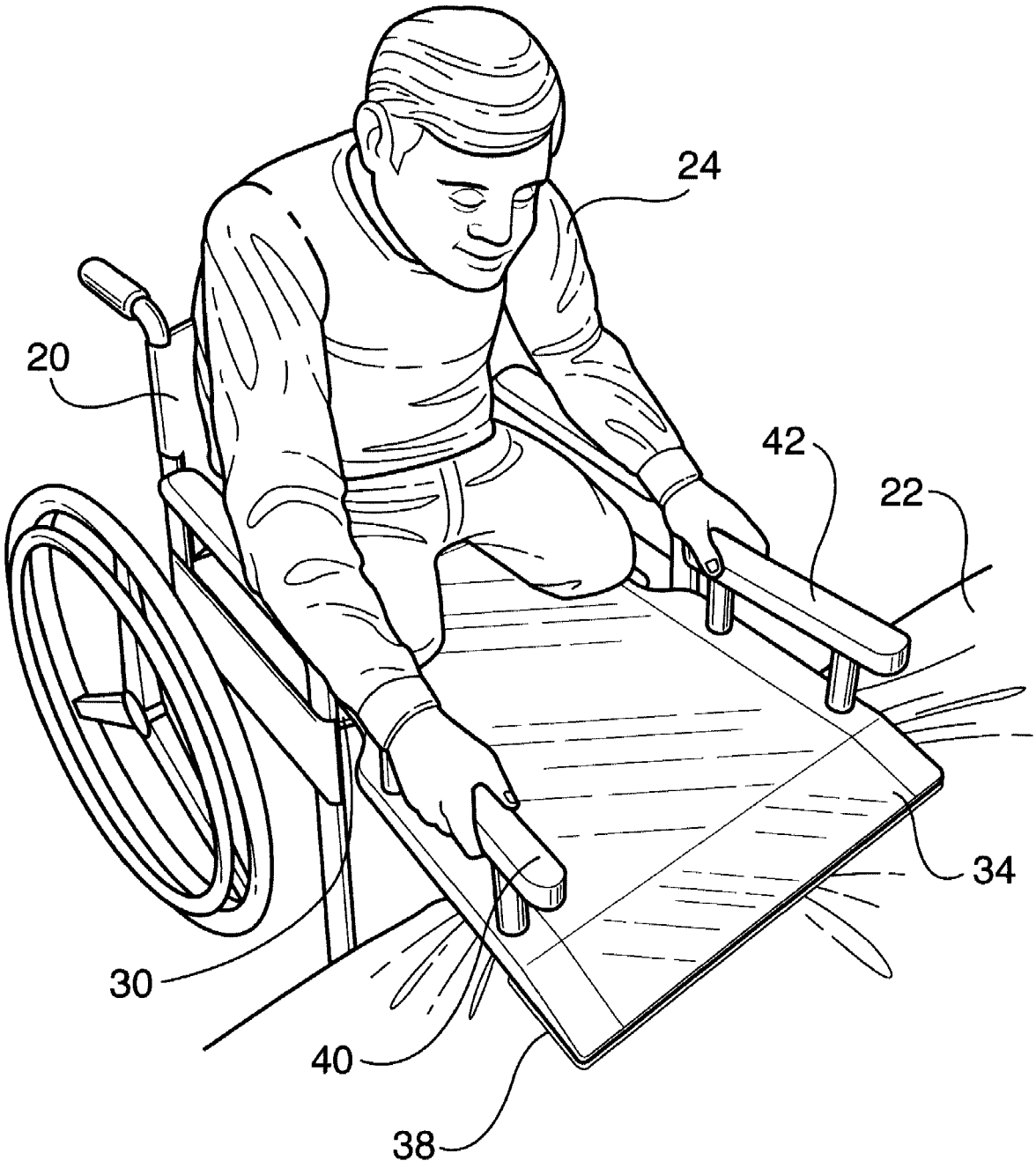
FIG. 2 is a view similar to FIG. 1 but showing a patient helping to move himself from a wheelchair to a bed.

Referring now to the drawings in detail wherein like reference numerals have been used in the two figures to designate like elements, there is shown in FIGS. 1 and 2 a transfer board constructed in accordance with the principles of the present invention and designated generally as 10. The transfer board 10 is comprised essentially of two main parts: a board 12 and a pair of handles 14 and 16.

The board 12 is similar in many respects to conventional transfer boards. As with conventional boards, it is preferably made of plywood or plastic or other rigid material capable of supporting the weight of an adult patient. The upper surface 18 of the board 12 is smooth and somewhat slippery which allows a person to slide across the same between a wheelchair 20 and a bed 22 or other similar support surface.

The length of the board 12 is approximately 26 to 30 inches although this may vary slightly. If the board is too long, it may be dangerous as the patient 24 would have the potential of falling off of the sides of the board during a transfer. As shown most clearly in FIG. 1, the first end section 26 of the board 12 is narrower than the second end section 28. In the preferred embodiment of the invention, the width of the first end section 26 is approximately 13 to 17 inches and has a length of approximately 10 to 14 inches so that it can fit comfortably on the seat 30 of the wheelchair

20. The width of the second end section 28 of the board 12 is slightly wider than the width of the first end section 26 and preferably is between approximately 16 to 20 inches. This wider width of the second end section 28 provides more stability to the transfer board 10.

As with other known transfer boards, the extreme ends of the board are tapered downwardly as shown at 32 and 34 to assist a person in sliding onto and off of the board. In addition, the undersurface of at least the ends of the board includes a nonslip material such as shown at 36 and 38. It is, of course, possible to provide the nonslip surface throughout the entire bottom of the board 12.

The handles 14 and 16 are located on the left and right sides of the board on the second section 28 thereof. The handles are comprised of upper elongated bars 40 and 42 that run in the direction of the length of the board 12. These bars 40 and 42 are located above the upper surface 18 of the board 12 so that a person can grasp the bars and place his or her hand around the same with their fingers located below the bars but above the surface 12. This allows the person to obtain a good solid grip on the handles.

The bars 40 and 42 are secured to the board 12 through uprights 44, 46, 48 and 50. As best shown in FIG. 3, the uprights 44, 46, 48 and 50 have lower ends that are secured directly to the top of the upper surface of the board 12. As a result, the handles 14 and 16 are rigidly secured to the board and are immovable. Thus, a person sitting on the board can grasp the bars 40 and 42 of the handles and push downwardly on them to move his or her body across the board without the handles moving in any manner. In the preferred embodiment of the invention, the length of the bars 40 and 42 that form the handles 14 and 16 are preferably about 15 to 21 inches.

The present invention may be embodied in other specific forms without departing from the spirit or essential attributes thereof and accordingly, reference should be made to the appended claims rather than to the foregoing specification as indicating the scope of the invention.

I claim:

1. A transfer board for assisting in moving a wheelchair bound person from a wheelchair to a bed or similar support or back from a bed to the wheelchair comprising:

a substantially flat elongated lightweight board having a length with a first end and a second end and having a first side and a second side, said first end being adapted to rest on the seat of a wheelchair and said second end being adapted to rest on a bed or similar support, said board having a smooth upper surface which allows a person to slide across the same between said wheelchair and said support;

a first rigid handle secured to said board adjacent said first side and a second rigid handle secured to said board adjacent said second side; each of said handles being elongated and having a length extending in the direction of the length of said board; each of said handles being positioned above said upper surface of said board and being so constructed and arranged so that a person sitting on the board can grasp the handles and push downwardly on them in order to move his or her body across the board without the handles moving, and wherein each of said handles is spaced from said surface of said board so that a person can place his or her hand around said handle with his or her fingers located below the handle but above the surface, said handles each including a pair of rigid uprights located between each handle and said surface for supporting each handle, said uprights having lower ends secured directly to said top surface of said upper surface.

2. The transfer board as claimed in claim 1 wherein said board is comprised of first and second sections integrally connected to each other, said first section being adjacent said first end and said second section being adjacent said second end, said first section being narrower in width than said second section and being capable of fitting onto the seat of a wheelchair, said second section being longer than said first section and wherein said handles are located on said second section.

3. The transfer board as claimed in claim 1 wherein said ends are inclined downwardly to assist a person in sliding onto and off of said board.

4. The transfer board as claimed in claim 1 wherein the underside of said board includes a nonslip surface thereon.

* * * * *